US008117884B2

(12) United States Patent
Deriaz

(10) Patent No.: US 8,117,884 B2
(45) Date of Patent: Feb. 21, 2012

(54) METHOD FOR PRODUCING INTERNAL AND EXTERNAL TOOTHINGS ON THIN-WALLED, CYLINDRICAL HOLLOW PARTS

(75) Inventor: Daniel Deriaz, Meilen (CH)

(73) Assignee: Ernst Grob AG, Mannedorf (CH)

( * ) Notice: Subject to any disclaimer, the term of this patent is extended or adjusted under 35 U.S.C. 154(b) by 1075 days.

(21) Appl. No.: 11/994,376

(22) PCT Filed: Jul. 15, 2005

(86) PCT No.: PCT/CH2005/000406

§ 371 (c)(1),
(2), (4) Date: Dec. 31, 2007

(87) PCT Pub. No.: WO2007/009267

PCT Pub. Date: Jan. 25, 2007

(65) Prior Publication Data

US 2010/0126020 A1 May 27, 2010

(51) Int. Cl.
*B21C 37/20* (2006.01)
*B21J 7/16* (2006.01)
*B23P 15/10* (2006.01)

(52) U.S. Cl. ..... 72/370.16; 72/74; 72/402

(58) Field of Classification Search ..... 72/74, 76, 72/352, 354.2, 370.01, 370.16, 370.21, 393, 72/402; 29/893.34
See application file for complete search history.

(56) References Cited

U.S. PATENT DOCUMENTS 3,352,138 A 11/1967 Haug
1,324,090 A 7/1973 Francis
3,935,756 A * 2/1976 Ebert ..... 72/370.21
5,634,367 A * 6/1997 Yamada et al. ..... 72/402
5,894,753 A * 4/1999 Sachot et al. ..... 72/402

FOREIGN PATENT DOCUMENTS

DE 12 80 198 B 10/1968

OTHER PUBLICATIONS

International Preliminary Report on Patentability; International application No. PCT/CH2005/000406; International filing date: Jul. 15, 2005, Report issued Jan. 29, 2008.
Written Opinion of the International Searching Authority; International Application No. PCT/CH2006/000406; International filing date: Jul. 15, 2005.
Krapfenbauer H: "Neue Kaltwalzverfahren Zur Herstellung Verzahnter Hohlteile" F& M Feinwerktechnik Mikrotechnik Messtechnik, Hanser, Munchen, DE, Bd. 102, Nr. 9, Sep. 1, 1994; S21-S23.
International Search Report; International Application No. PCT/CH2005/000406; International Filing Date: Jul. 15, 2005.

* cited by examiner

*Primary Examiner* — Teresa Ekiert
(74) *Attorney, Agent, or Firm* — Antonelli, Terry, Stout & Kraus, LLP.

(57) ABSTRACT

A method is disclosed for cold-form profiling cylindrical, thin-walled hollow parts (1), comprising profiles (4) which extend in an essentially parallel manner in relation to the longitudinal axis (A) of the hollow part (1). At least one profiling tool (5) engages in a strike-like hammering manner with the outside of the hollow part (1) in a radial manner in relation to the longitudinal axis (A) o the hollow part (1). The profiling tool (5) engages, respectively, in an essentially vertical and oscillating manner on the surface of the hollow part (1). Then, the profiling tool (5) is displaced in an axial manner in relation to the hollow part (1) at a constant radial adjusting depth until the desired profile length is obtained.

22 Claims, 3 Drawing Sheets

METHOD FOR PRODUCING INTERNAL AND EXTERNAL TOOTHINGS ON THIN-WALLED, CYLINDRICAL HOLLOW PARTS

RELATED APPLICATION

This is a U.S. national phase application under 35 U.S.C. §371 of International Application No. PCT/CH2005/000406 filed Jul. 15, 2005.

TECHNICAL FIELD

The present invention concerns a method for cold rolled profiling of a cylindrical thin-walled, hollow workpiece as well as an apparatus for execution of the method.

BACKGROUND AND SUMMARY

The manufacture of axial profiling of a thin-walled, cylindrical hollow part (hereinafter, "workpiece") can, for example, be carried out by means of a cold rolling process. Accordingly, methods are known, wherein rotational tools, designated as profiling rollers, which are confined in circular orbits, are caused to repeatedly impact against the circumferential surface of a workpiece. By means of an axial progression of the workpiece relative to the profiling tool and with the aid of axially toothed mandrels, the desired toothing can be realized. Profiling in this manner is effective in producing internal and external toothing in the thin wall of the said cylinder. However, a continual disadvantage of this conventional method, attributable to varying diameters of the profiling tool orbits, is that the produced longitudinal toothing profiles possess curvatures with radii which are larger or smaller than desired.

Another disadvantage of the above described method of cold forming by means of profiling rollers, lies in the fact that toothing on a workpiece which possesses an annular shoulder, cannot be brought up tightly against the said shoulder. Limited by the diameter of the said orbit of the profiling roller, a defined section of the workpiece remains unchanged between the termination of the axial extent of the profiling and the shoulder, which cannot be subjected to profiling action.

Thus, the purpose of the present invention is to find a method and an apparatus, which will permit an exact toothing of thin-walled, cylindrical hollow bodies corresponding to a specified geometry, wherein the clearance to a shoulder is minimized.

This purpose is achieved, in accord with the invention, with a method for profiling of a cylindrical, thin-walled, hollow workpiece by cold-forming, comprising: creating a profile running essentially parallel to a longitudinal axis of the hollow workpiece by means of at least one profiling tool arranged externally to said hollow workpiece and carrying out, in a direction radial to said longitudinal axis, hammering metal working impacts against the workpiece; the at least one profiling tool executing its metal-working impacts onto an external surface of the workpiece while oscillating in a direction essentially perpendicular to said longitudinal axis; and accomplishing a relative movement of said profiling tool and said workpiece in axial direction while maintaining constant a radial profiling depth setting, until a desired axial length of profiling on the workpiece is achieved; wherein the profiling tool is designed as a metal working die comprising an active operational side having in a plane perpendicular to said longitudinal axis a cross-section corresponding to the contour of the profile to be created in the external surface of the workpiece, the active operational side having a lower edge which is inclined at an acute angle relative to said longitudinal axis, except for a calibration zone which is aligned parallel to the longitudinal axis, wherein said calibration zone forms an end portion of said lower edge, and wherein said calibration zone is that portion of said lower edge which is located closest to the surface of the workpiece.

And, this purpose is also achieved by means of a method for profiling of a cylindrical, thin-walled, hollow workpiece by cold-forming, comprising: creating a profile running essentially parallel to a longitudinal axis of the hollow workpiece by means of at least one profiling tool arranged externally to said hollow workpiece and carrying out, in a direction radial to said longitudinal axis, hammering metal working impacts against the workpiece; the at least one profiling tool executing its metal-working impacts onto an external surface of the workpiece while oscillating in a direction essentially perpendicular to said longitudinal axis; accomplishing a relative movement of said profiling tool and said workpiece in axial direction while maintaining constant a radial profiling depth setting, until a desired axial length of profiling on the workpiece is achieved; and intermittently rotating said hollow workpiece about said longitudinal axis, wherein said intermittent rotation of the workpiece is synchronized with the oscillating movement of the profiling tool.

In addition, this purpose is achieved by means of an apparatus disclosed herein.

Attention is called to the invented method for the cold rolling profiling of the workpieces, wherein, essentially, splines or teeth are circumferentially apportioned about the said workpiece. These teeth extend, for example, parallel to the longitudinal axis of the workpiece, whereby at least one externally placed profiling tool is applied. This profiling tool produces repeated impacts against the circumferential wall of the workpiece in a direction transverse to the said longitudinal axis thereof. In this way, a hammering operation is furnished, whereby the said profiling tool continually oscillates essentially in a resulting radial direction against the surface of the workpiece, thus achieving the desired metal shaping. In addition, the profiling tool, besides operating in a uniform radial depth oscillation, is also caused to move axially along the length of the workpiece, up to a predetermined, axial length of the desired toothing.

In this way, in a single manufacturing operation, the toothed profile has been made throughout its entire specified length. Simultaneously, the tooth shaping and cold-rolling operations have been consolidated into a multiplicity of incremental steps. Accordingly, it becomes advantageously possible to hold the functional effect of each incremental step at a relatively small level. This leads to obtaining a high degree of precision of the produced profiling, that is to say, of both the inner and the outer formation of teeth, and accordingly allows a superior formation of the said toothing. Especially, it is possible, with the invented method, to produce profiled teeth, for example, of relatively small radii. This ability permits that part of the workpiece wall, which carries the said precise profiling, to be extended to a decisively increased distance with identical toothing. On this account, the profiling tool, giving consideration to its radially oriented motion relative to the circumference of the workpiece, can be axially run to a profiling position proximal, within a close tolerance, to the said annular shoulder about the workpiece, so that thereby, profiling up to a narrow clearance from said shoulder becomes possible. The advantage lies therein, in that the profiling tool performs practically no uncontrolled motion of its own in the axial direction and thereby no free wobble-room in the axial direction of the working surface becomes a disadvantage.

In an exemplary manner, preliminary to its axial movement, the profiling tool can be adjusted to a predetermined profile depth, measured radially to the longitudinal axis of the workpiece. Because of the fact, that the profiling tool, preliminarily to the actual metal working process, has been radially placed in a position external to the workpiece, sufficient free installation space in the workpiece exists so that the said profiling tool can be easily connected to a holding mechanism.

Advantageously, it is possible, that at least once, a change of direction of the axial transport direction relative to the profiling tool and the workpiece can be carried out. This is advantageously done following the reaching of the specified length of the toothing. Specifically, the said changed direction is a retraction to the original start-position of the profiling tool relative to the workpiece. In this way, very high demands for precision and surface conditions of the toothing itself can be fulfilled.

Consideration can also be given to multiple back and forth traverses of the workpiece in the axial direction, these movements being relative to the profiling tool. This reciprocal movement would be intended to obtain a desired degree of surface quality.

In an exemplary manner, respectively following the conclusion of its relative axial movement, the profiling tool is radially lifted out of the toothing of the workpiece. When this conclusive event has been completed, then the finally completed workpiece can be simply removed from the metal working machinery and a new, so-called raw workpiece inserted therein. With the invented method, it is possible, that, advantageously, a predetermined profiling, such as, for instance, a toothing with a specified inter-spacing could be produced.

For instance, an oscillatory thrust motion of the profiling tool can be adjusted to be greater than the maximum radial depth of impression of the profiling tool into the workpiece. In such a situation, the workpiece can be, advantageously, intermittently rotated about its axis, namely in synchrony with the oscillating thrust action. This synchronized adjustment also, advantageously, determines the spatial separation distance of the profiling to be made.

Advantageously, it is possible to operate the profiling tool at more than 1000 impacts per minute, preferably at even more than 1500 impacts per minute. In this way, very high rates of production can be achieved, which is of advantage for the mass production of the auto industry.

In addition, the workpiece under production is superimposed upon a complementarily toothed mandrel, whereby the said mandrel is in impacting opposition to the profiling tool. With this aid, both the outer—as well as the inner—profile of the workpiece can be quickly and precisely fabricated.

For example, the profiled zone of the mandrel can extend from its free end to a radially, projecting annular shoulder and the open end of a workpiece is set thereupon, wherein the said workpiece also exhibits a surrounding shoulder, i.e. in other words, possesses a limiting obstruction to further profiling tool advance. Such workpieces find application in automotive motor construction, for instance serving for the transfer of rotary motion and torque in automatic transmissions. In this application, the extent of the profile must extend itself in design and manufacture as an exact inner and outer toothing, closely approaching in an axial direction the outward projecting collar of the workpiece.

For example, if the profiling tool, during the first part of the operative method, be brought into proximity of the shoulder of the mandrel, that is to say, into that section of the end section of the workpiece which is radially subjected to profiling, then subsequently, during the second part of the operative method, the said mandrel is axially and slidingly displaced away from the said profiling tool. As these stated occurrences take place, then either the profiling tool or (advantageously) the workpiece can be axially moved by the metal working machine, in order to effect a controlled, axial, relative displacement between the said workpiece and the profiling tool. This relative movement is carried out for such a length of time until the axial distance is reached, wherein the profiling tool can no longer operate in profiling the workpiece. Further, this said movement is designated as being carried out under tension, i.e. by a "pulling action", since the profiling tool, practically immediately after a workpiece-impression operation, is pulled along, until the entire specified length of the profiling has been completed.

For example, the profiling tool is initially designed to operate at the free end of the workpiece, that is, to be adjusted to a radially opposing configuration against the said mandrel, wherein the said mandrel or the workpiece can be moved axially along the workpiece, until blocked by the said shoulder. This movement would continue until the profiling tool has reached a point immediately proximal to the shoulder of the mandrel, in other words, the said movement continues over a specified distance wherein the circumference of the workpiece is to be subjected to metal working. Even in this case, obviously, it is possible that the relative interactive work between the profiling tool and the workpiece can be carried out by means of an axial sliding of the workpiece.

This axial displacement is looked upon as an impact centered movement, since the profiling tool primarily shapes and completes the profiling of the circumference of the workpiece. In this way, it is possible that the said tool, while yet separate from the free end of the workpiece, can be adjusted to a predetermined toothing depth and only thereafter be functionally applied to the workpiece.

As an example, the profiling can be carried out, respectively, by at least two profiling tools, which are situated radially opposite to one another. The profiling tools of this pair of profiling tools, are advantageously driven in concert with one another in conformation with their radial disposition and their synchronized oscillatory motion. Thereby, an optimal apportionment and application of profiling force can be assured. Again, in an exemplary manner, the profiling tool can be adjusted for radial motion in relation to the workpiece, in a continual or discrete stepwise manner, to attain the desired final profile depth on the workpiece.

In accord with the invention, the stated purpose thereof can be achieved by means of an apparatus having the features as disclosed herein. Additional, advantageous, invented embodiments of the apparatus become evident by reference to the features of the apparatus disclosed herein.

The apparatus comprises at least one eccentrically operated drive; at least one profiling tool operationally connected to said at least one eccentrically operated drive; a workpiece holder in the form of a mandrel for holding a hollow workpiece, said workpiece holder being movable along a longitudinal axis of the mandrel relative to said profiling tool; a drive for rotating said mandrel about said longitudinal axis; wherein the profiling tool is designed as a metal working die comprising an active operational side having in a plane perpendicular to said longitudinal axis a cross-section corresponding to the contour of the profile to be created in an external surface of a hollow workpiece held by said workpiece holder, the active operational side having a lower edge which is inclined at an acute angle relative to said longitudinal axis, except for a calibration zone which is aligned parallel to the longitudinal axis, wherein said calibration zone forms an end portion of said lower edge, and wherein said calibration zone is that portion of said lower edge which is located closest to said mandrel.

In accord with the invention, the apparatus possesses, for the purpose of carrying out the invented method, at least one, operationally active, profiling tool holder having an eccentrically operated drive. The said apparatus further encompasses: a mandrel capable of (relatively) of being axially and slidably displaced in reference to the said axially aligned profiling tool holder and/or the holder for the workpiece; a drive for the axis-centered rotation of the mandrel and for the workpiece holder; and at least one profiling tool, designated also as a metal shaping die. In this arrangement, the said die possesses a working profile, which, as a die, corresponds to the shape of the external contour of the incipient workpiece profile. Additionally, the said working profile of the tool, in other words, the operational impacting surface, can be adjusted to an acute angle relative to the longitudinal axis, however, with the exception of a zone thereof, which is radial to the smallest possible distance away from the circumferential surface of the workpiece and which is designated as a calibration area running parallel to the longitudinal axis of the said workpiece. Thereby, the said calibration area is the first to make an impression on the surface of the workpiece, since this contacted zone of the said surface has the greatest proximity to the said profiling tool. After an impression by the calibration zone, it is especially possible, due to cold working properties of the thin metal of the workpiece, that respectively also the remainder of the die surface (other than the calibration zone) impinges into the said circumferential surface, and a preliminary, initial metal working of the workpiece thereby takes place. In the second part of the method, the die, which has a constant radial adjustment, moves axially along the circumference of the workpiece, then the said calibration zone is required to take upon itself a subsequent start of the formation of the desired profile.

Again, as an example, the depth of the die impression, i.e., the depth of the profile of the working tool, is made deeper than the depth of the profiling to be accomplished on the workpiece. Accordingly, for example, during the progressive, stepwise axial displacement of the workpiece, the entire, radially adjusted, predetermined depth of the profile is obtained For instance, the length of the calibration zone corresponds to only a fraction of the entire axial length of the profiling, that is to say, the entire length of the operational profile. This calibration zone is, finally, a governing element for the formation and the precision of the profiling, since, at the end of the radial adjustment only this calibration zone comes into contact with the workpiece. Advantageously, the profiling die of the profiling tool is made of high-strength material and possesses, for example and has been subjected to an appropriate heat treatment, so that the longest possible operational life can be obtained and therewith a high degree of precision of the produced profiling, even at the cost of a longer period for mandrel construction.

The apparatus possesses at least two, profiling tools, each of which lies opposite to the other in a line transverse to the longitudinal axis of the hollow, cylindrical workpiece. Accordingly, an optimal input of force and apportionment thereof is assured for the workpiece. Even the forces in the apparatus itself can be optionally picked up and properly distributed. Consideration may be given to other arrangements, advantageously respective symmetrical alignments of the profiling tools.

BRIEF DESCRIPTION OF DRAWINGS

In the following, an embodiment of the present invention, with figures based thereon, is described and explained in greater detail. There is shown in.

DETAILED DESCRIPTION

Figure 1:
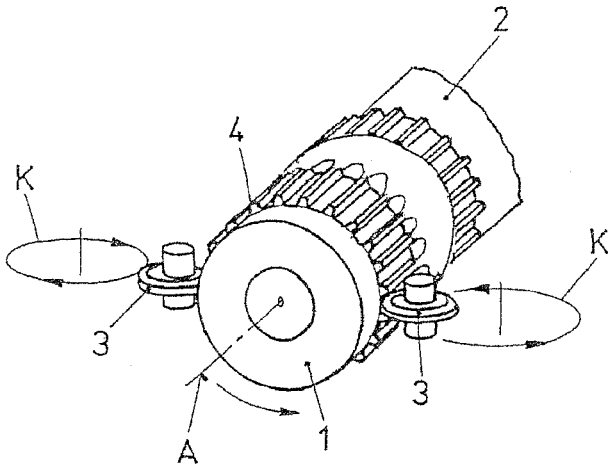
FIG. 1 schematically the principal construction of a conventional impact roller profiling apparatus, wherein the profiling roller tool is indicated as rotating about a circular orbit, FIG. 2 schematically the principal construction of the invented profiling apparatus, for the carrying out of the method in accord with the invention, FIG. 3 a longitudinal section through a tubular workpiece, which is set upon a mandrel, prior to the metal working by means of the invented profiling tool, FIG. 4 a longitudinal section based on FIG. 3, in accord with the first operational step of the invented method, FIG. 5 a cross-section through the operational zone of the longitudinal section of FIG. 4, FIG. 6 a sectional view through a tubular workpiece superimposed upon a mandrel prior to an alternative processing by a profiling tool, and FIG. 7 a side view of an invented profiling tool.

FIG. 1 shows, in a schematic manner, the assembly of the principal parts of a conventional profiling tool, operating with a rolling impact head for the production of inner and outer teething on a thin walled, cylindrical, hollow object 1 (as stated above, here designated as "workpiece"). The said workpiece 1 is caused to encase an already profiled mandrel 2. The outer circumferential surface of the said workpiece 1 is subjected to impact metal working by means of profiling rollers 3, which themselves rotate in respective orbits K, which orbits K are in a plane transverse to the longitudinal axis A of the said workpiece 1. Accordingly, the profiling rollers 3 themselves are likewise positioned radially transverse to the said longitudinal axis A. These rollers remain actively in place until the desired depth of the profiling on the workpiece 1 has been reached. FIG. 1 makes plain, that the profile 4 on the workpiece 1, at its exposed end, terminates with a straight radial face transverse to the longitudinal axis A. However, the profiled teeth continue longitudinally with a radius corresponding to that of the said orbit K. If the profile 4 must be longitudinally continued up to a tight closure with an annular shoulder, which projects radially from the outer surface of the workpiece 1, then neither this above described method nor the associated apparatus therefor can be employed.

Figure 2:
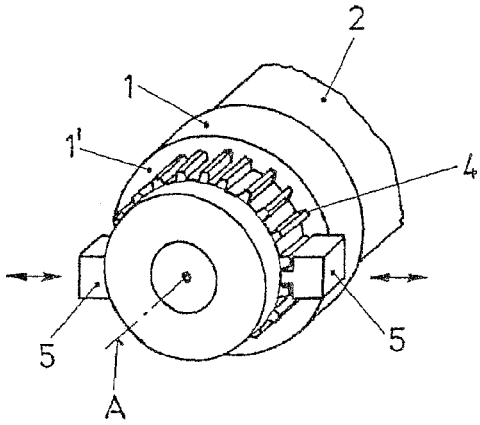

In FIG. 2 is to be found a schematic presentation of the principal assembly of an apparatus for the invented metal working of a workpiece 1. In this case, likewise, a profiled mandrel 2 is inserted into the workpiece 1, which is to be furnished with profiling. The workpiece 1, in this case, possesses a shoulder 1' rising outward from its circumferential surface. The profile 4 is now expected to run from the exposed end face up to the smallest possible increment of separation from the said shoulder. For this purpose, a profiling tool 5 is placed in operation, which can be installed radially in reference to the axis A of the workpiece 1. The profiling tools 5, of which there are, for example, two, are driven in a linear, oscillating motion and are placed exactly in one radial plane transverse to the axis A of the workpiece 1. The eccentric drive unit, for the sake of simplification, is not shown.

Figure 3:
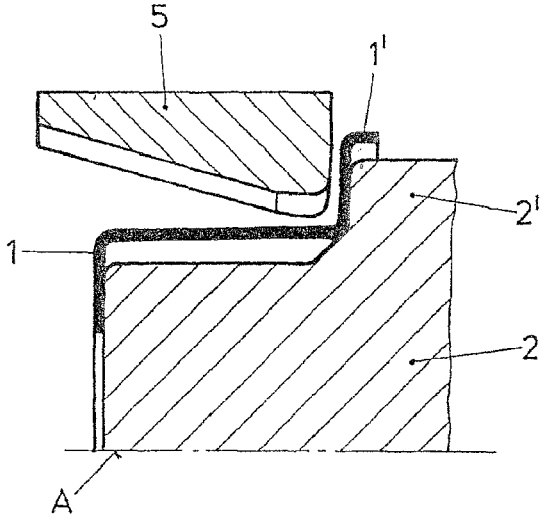

FIG. 3 shows a longitudinal view of a section through the mandrel 2 with the superimposed workpiece 1 thereon. In this figure, the profiling tool 5 finds itself at the starting position for working up to the shoulder 1' of the workpiece 1. The workpiece 1, in this illustration, is being pressed in the axial direction firmly against the mandrel 2. The said mandrel possesses, advantageously, its own toothing, that is to say, its own longitudinally directed profiling, which is encapsulated by the workpiece 1. Further, the mandrel 2 exhibits its own shoulder 2'.

Figure 4:
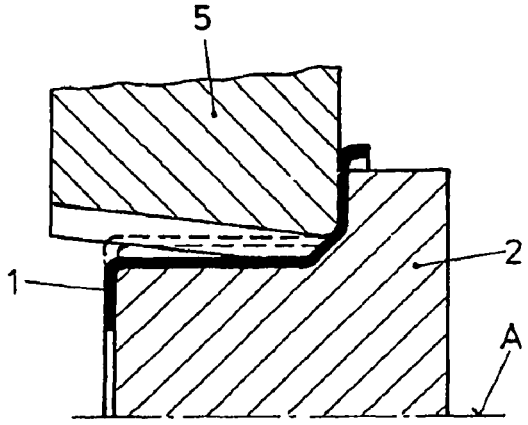

The profiling tools 5 are now operating in a first method step, performing an impact based, oscillating hammering action against the circumferential surface of the wall of the workpiece 1. Simultaneously, this said oscillating hammering action of the profiling tool 5 is, in this first method step, subjected to a depth adjustment, which takes place radially transverse to the longitudinal axis of the workpiece 1 to assure that the profiling is brought to a predetermined, specified depth, as is made evident in the longitudinal section of FIG. 4. At the termination of this first procedural step, the profile in the area of the workpiece shoulder 1' has been primarily shaped, although it has first acquired its desired contour on the left side (in reference to the drawing) but has not yet received its full finished formation.

Because of the axial sliding motion of the workpiece 1, relative to the profiling tool 5 in a second procedural step, the profiling tool, which functions with a constant pre-adjusted depth, is withdrawn partially out of the workpiece 5. In this way, the fully finished formation of the profile can be achieved along its entire predetermined axial length.

Figure 5:
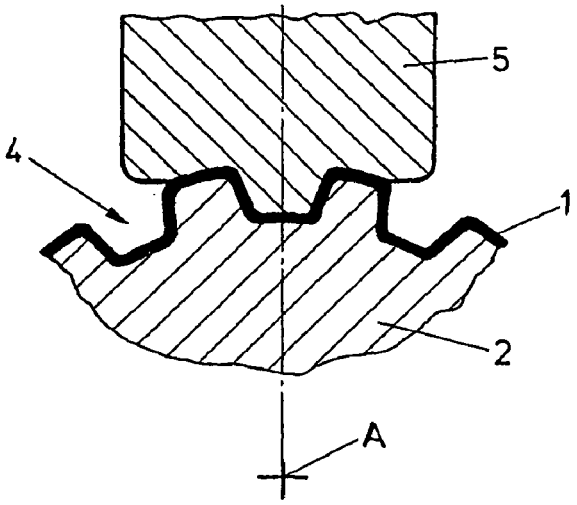

In the cross-section presented by FIG. 5, the profiling tool 5 is shown in its specified adjusted depth and at its lowest intrusion in its die type function, i.e., in its deepest impression. In this case, the finished fully formed contour of the profile 4 is exhibited especially clearly in its cross-sectional intrusion into the workpiece 1.

In a typical manner, it is possible that the profiling tool 5 can be driven at a striking frequency of more than 1000 impacts per minute, preferably even more than 1500 impacts per minute. Under these circumstances, the profiling tool 5, which makes a rotation in incremental steps, can be repeatedly producing an indentation of at least 0.1 mm, until the specified profile depth has been achieved.

Figure 6:
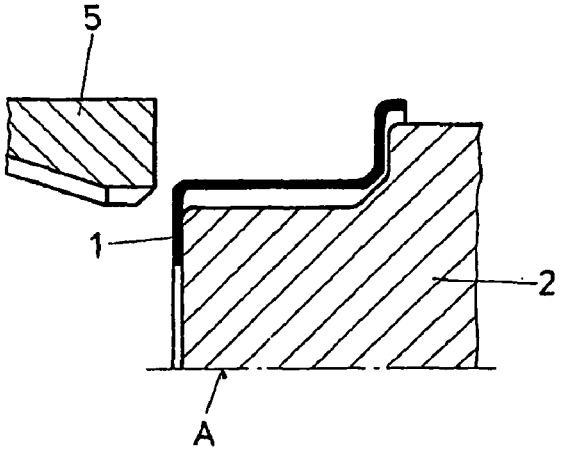

Now going to FIG. 6, we see the longitudinal cross-section through a workpiece wall, as shown in FIG. 3, whereby in this case, the profiling tool 5 stands in its starting position, ready for the metal working to ensue. The profiling tool 5 finds itself axially disposed before the end face of the workpiece wall in place with its radial depth already adjusted. For the actual metal working of workpiece 1, the profiling tool 5 would be caused to move axially in the direction of the shoulder 1' of the workpiece 1, up to a point whereat the desired length of the profiling has been attained. The workpiece 1, under these circumstances, lies advantageously close to the end face of the mandrel 2 and the shoulder 1' of said workpiece possesses in relation to the shoulder 2' of the mandrel 2 a small tolerance of play. This allows that the material of the workpiece 1 can, when subjected to metal working, expand itself in the direction of the shoulder 2'. It would be obvious to the expert, that this relative movement in the apparatus itself can be self-initiated by the sliding of the workpiece 1 and/or the mandrel 2 in relation to the profiling tool 5.

Figure 7:
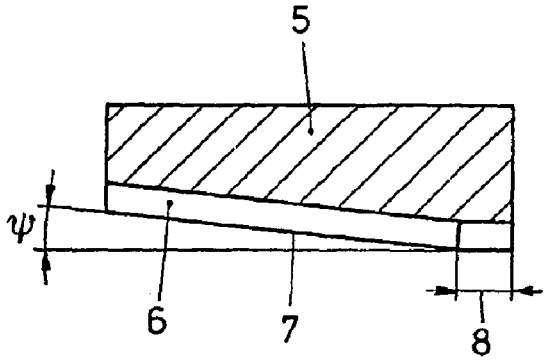

FIG. 7 illustrates a side view of a profiling tool 5, showing, for example, the manner in which it could be installed to carry out the invented method. The profiling tool 5, is designed to provide the function of a metal forming die and shows on its active operational side 6, a cross-section of the proposed profile 4 to be impressed on the workpiece 1, this cross-section having, for example, a trapezoidal shape. The lower edge 7 of the operational side 6 is, in this view, inclined at an acute angle $\phi$ relative to the axis A of the workpiece 1. This angle represents the shape and the depth of the profile 4 to be produced and is sized namely between 0.5° and 10°.

This said lower edge 7 runs for example, in this embodiment, in a straight line, although alternately, it can be, to a small degree, slightly curved. On the right end of the profiling tool 5, in accord with FIG. 7, is to be seen a calibration zone 8. In the area of this calibration zone 8, the lower edge 7 runs parallel to the axis A of the workpiece 1 and the contour of the metal working surface 6 corresponds to the cross-section of the profile to be impressed on the circumferential outer surface of the workpiece 1. The lower edge 7 extends itself at the above described acute angle away from the calibration zone 8. If necessary, instead of a straight line of departure, the path can be an arc to the oppositely lying ends of the profiling tool 5. This angle, or, alternately this arc, corresponds to the contour of the metal forming area of the profile 4 to be produced. Experience has shown, that it is of advantage, if the length of the calibration zone occupies only a fraction of the entire length of the profiling tool 5.

The axially progressive incremental advancement of the workpiece 1 in relation to the mandrel 2, advantageously, conforms to the length of the calibration zone 8. In the case of two oppositely situated radially installed profiling tools 5, also the said increment of advancement would be, at a maximum, twice the length of the said calibration zone 8, during a complete revolution of the profiling tool about the workpiece 1.

The radial extent of the axial indenting movement of the oscillating profiling tool 5 is adjusted in such a way, that it is greater than the maximum radial depth of the first method step. This provides clearance, so that the profiling tools 5 can lift themselves after each thrust to be free of the surface of the workpiece 1. At this point of position and time, the workpiece 1 and the mandrel 2, in synchronization with the oscillation of the profiling tool 5, make a partial rotation limited to one profile increment. In keeping therewith, successive rotational movements are advantageously carried out so that repeated impact operations of the profiling tool 5 to form a neighboring profile 4 are carried out. In this way, a very precise and uniform profiling about the entire circumference of the workpiece can be achieved.

By means of the above stated high frequency of the impact operation, very high production rates can be obtained. This is of particular interest in the automotive industry.

The invention claimed is:

1. A method for profiling of a cylindrical, thin-walled, hollow workpiece by cold-forming, comprising:

creating a profile running essentially parallel to a longitudinal axis of the hollow workpiece by means of at least one profiling tool arranged externally to said hollow workpiece and carrying out, in a direction radial to said longitudinal axis, hammering metal working impacts against the workpiece;

the at least one profiling tool executing its metal-working impacts onto an external surface of the workpiece while oscillating in a direction essentially perpendicular to said longitudinal axis; and accomplishing a relative movement of said profiling tool and said workpiece in axial direction while maintaining constant a radial profiling depth setting, until a desired axial length of profiling on the workpiece is achieved;

wherein the profiling tool is designed as a metal working die comprising an active operational side having in a plane perpendicular to said longitudinal axis a cross-section corresponding to the contour of the profile to be created in the external surface of the workpiece, the active operational side having a lower edge which is inclined at an acute angle relative to said longitudinal axis, except for a calibration zone which is aligned parallel to the longitudinal axis, wherein said calibration zone forms an end portion of said lower edge, and wherein said calibration zone is that portion of said lower edge which is located closest to the surface of the workpiece.

2. The method according to claim 1, wherein previous to said relative movement of said profiling tool and said workpiece in axial direction, the profiling tool is adjusted to a predetermined profiling depth setting radial to the longitudinal axis of the workpiece.

3. The method according to claim 1, including changing a direction of said relative movement of said profiling tool and said workpiece in axial direction.

4. The method according to claim 3, wherein said changing said direction is accomplished after reaching a desired axial length of profiling, said changing said direction leading back to an original starting point.

5. The method according to claim 1, comprising retracting the profiling tool out of the profile in the hollow workpiece after a respective completion of said relative movement of said profiling tool and said workpiece in axial direction.

6. The method according to claim 1, comprising selecting the oscillating movement of the profiling tool to be greater than a maximal radial depth of penetration of the profiling tool into the hollow workpiece, and wherein the workpiece is intermittently rotated about said longitudinal axis, wherein said intermittent rotation of the workpiece is synchronized with the oscillating movement of the profiling tool.

7. The method according to claim 6, wherein said oscillating movement of the profiling tool and said intermittent rotation of the workpiece are synchronized for causing that subsequent hammering metal working impacts of the profiling tool against the workpiece are caused to take place in a distance of a pitch of the profile.

8. The method according to claim 1, comprising placing the hollow workpiece onto a mandrel having a profile, the mandrel being movable along the longitudinal axis of the workpiece relative to the profiling tool.

9. The method according to claim 8, wherein the profile of the mandrel extends from a free end of the mandrel up to a shoulder of the mandrel protruding radially outward, and wherein the hollow workpiece placed onto the mandrel is pot- or jar-shaped and has a rim or a shoulder.

10. The method according to claim 9, wherein firstly, said radial hammering metal working impacts of the profiling tool against the workpiece take place in a region of the shoulder of the mandrel and a region of the rim or the shoulder of the workpiece, respectively, and thereafter, the mandrel and the hollow workpiece, respectively, are moved relative to the profiling tool along said longitudinal axis, so as to increase a distance measured along said longitudinal axis between said profiling tool and said shoulder of said mandrel and a distance measured along said longitudinal axis between said profiling tool and said rim or shoulder of said workpiece, respectively.

11. The method according to claim 10, wherein said movement of the mandrel and the hollow workpiece, respectively, relative to the profiling tool along said longitudinal axis is carried out until said distance is increased to the point where the profiling tool can no more accomplish said radial hammering metal working impacts against the workpiece.

12. The method according to claim 9, wherein, in a region of said free end of the mandrel, the profiling tool is adjusted to a predetermined profiling depth setting radial to the longitudinal axis of the workpiece, and thereafter, the mandrel is moved relative to said profiling tool along said longitudinal axis.

13. The method according to claim 12, wherein the mandrel is moved relative to said profiling tool along said longitudinal axis until the profiling tool carries out said radial hammering metal working impacts against the workpiece in close proximity to the shoulder of the mandrel and the rim or the shoulder of the workpiece, respectively.

14. The method according to claim 1, comprising using at least two profiling tools lying diametrically opposite to one another.

15. The method according to claim 14, wherein said at least two profiling tools are driven in a mutually synchronized manner with respect to their radial profiling depth setting and with respect to their oscillating movement.

16. The method according to claim 1, wherein an adjustment of the profiling depth setting radial to the longitudinal axis of the workpiece is carried out continuously or in discrete adjustable steps, until a specified depth of the profile of the hollow workpiece is reached.

17. A method for profiling of a cylindrical, thin-walled, hollow workpiece by cold-forming, comprising:

creating a profile running essentially parallel to a longitudinal axis of the hollow workpiece by means of at least one profiling tool arranged externally to said hollow workpiece and carrying out, in a direction radial to said longitudinal axis, hammering metal working impacts against the workpiece;

the at least one profiling tool executing its metal-working impacts onto an external surface of the workpiece while oscillating in a direction essentially perpendicular to said longitudinal axis;

accomplishing a relative movement of said profiling tool and said workpiece in axial direction while maintaining constant a radial profiling depth setting, until a desired axial length of profiling on the workpiece is achieved; and intermittently rotating said hollow workpiece about said longitudinal axis, wherein said intermittent rotation of the workpiece is synchronized with the oscillating movement of the profiling tool.

18. An apparatus suitable for profiling of a cylindrical, thin-walled, hollow workpiece by cold-forming the apparatus comprising:

at least one eccentrically operated drive;

at least one profiling tool operationally connected to said at least one eccentrically operated drive;

a workpiece holder in the form of a mandrel for holding a hollow workpiece, said workpiece holder being movable along a longitudinal axis of the mandrel relative to said profiling tool;

a drive for rotating said mandrel about said longitudinal axis;

wherein the profiling tool is designed as a metal working die comprising an active operational side having in a plane perpendicular to said longitudinal axis a cross-section corresponding to the contour of the profile to be created in an external surface of a hollow workpiece held by said workpiece holder, the active operational side having a lower edge which is inclined at an acute angle relative to said longitudinal axis, except for a calibration zone which is aligned parallel to the longitudinal axis, wherein said calibration zone forms an end portion of said lower edge, and wherein said calibration zone is that portion of said lower edge which is located closest to the surface of the said mandrel.

19. The apparatus according to claim 18, wherein said drive for rotating said mandrel about said longitudinal axis is a drive for intermittently rotating said mandrel about said longitudinal axis.

20. The apparatus according to claim 18, wherein the length of the die is longer than the length of the profile to be created in an external surface of a workpiece.

21. The apparatus according to claim 18, wherein the length of the calibration zone is only a fraction of the length of the die and the length of the profile to be created.

22. The apparatus according to claim 18, including at least two profiling tools, wherein said tools lie, with respect to said longitudinal axis, opposite to one another.

* * * * *